US008158320B2

(12) United States Patent
Kim et al.

(10) Patent No.: US 8,158,320 B2
(45) Date of Patent: Apr. 17, 2012

(54) TONER AND PROCESS OF PREPARING THE SAME

(75) Inventors: In Kim, Suwon-si (KR); Ki-won Seok, Suwon-si (KR); Kyung-yol Yon, Seonguam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 684 days.

(21) Appl. No.: 12/193,923

(22) Filed: Aug. 19, 2008

(65) Prior Publication Data

US 2009/0155701 A1 Jun. 18, 2009

(30) Foreign Application Priority Data

Dec. 14, 2007 (KR) ..... 10-2007-0131076

(51) Int. Cl.
*G03G 9/08* (2006.01)

(52) U.S. Cl. ..... 430/110.3; 430/108.1; 430/108.6; 430/109.1; 430/109.3; 430/109.4; 399/222

(58) Field of Classification Search ..... 430/108.1, 430/108.6, 109.1, 109.3, 109.4, 110.3; 399/159, 399/222

See application file for complete search history.

(56) References Cited

U.S. PATENT DOCUMENTS

| | | | | |
|---|---|---|---|---|
| 3,993,484 | A * | 11/1976 | Rait et al. | 430/19 |
| 5,328,795 | A * | 7/1994 | Yamashiro et al. | 430/137.19 |
| 2005/0208408 | A1 * | 9/2005 | Uchinokura et al. | 430/108.21 |
| 2006/0063085 | A1 * | 3/2006 | Lee et al. | 430/108.22 |

FOREIGN PATENT DOCUMENTS

JP 05-127420 * 5/1993

OTHER PUBLICATIONS

Translation of JP 05-127420 published May 1993.*

* cited by examiner

*Primary Examiner* — Peter Vajda
(74) *Attorney, Agent, or Firm* — Stanzione & Kim, LLP

(57) ABSTRACT

A toner includes a core containing a binder resin, wax, and a colorant, and an external additive layer coating the core, wherein the core is prepared such that it is extruded and extended to have a fiber phase, and is pulverized. The toner has an improved fixing ability to allow an electrostatic image to be fixed at a low temperature while having an excellent durability and an improved storage stability, while exhibiting reduced toner blocking and offset phenomena.

18 Claims, 3 Drawing Sheets

TONER AND PROCESS OF PREPARING THE SAME

CROSS-REFERENCE TO RELATED APPLICATIONS

This application claims the benefit under 35 U.S.C. §119 (a) from Korean Patent Application No. 10-2007-0131076, filed on Dec. 14, 2007, in the Korean Intellectual Property Office, the disclosure of which is incorporated herein in its entirety by reference.

BACKGROUND OF THE INVENTION

1. Field of the Invention

The present general inventive concept relates to a toner and a process of preparing the same, and more particularly, the present general inventive concept relates to a toner used in an electrophotographic process and a process of preparing the same.

2. Description of the Related Art

In an electrophotographic process or an electrostatic recording process, a developer which is used to form an electrostatic image or an electrostatic latent image may be a two-component developer, which is formed of a toner and carrier particles, or a one-component developer, which is formed of only a toner. The one-component developer may be a magnetic one-component developer or a nonmagnetic one-component developer. Plasticizers such as colloidal silica are independently added to the nonmagnetic one-component developer in order to increase a flowability of the toner. In addition, coloring particles obtained by dispersing a colorant, such as a carbon black, or other additives in a binding resin, are also used in the toner.

Methods of preparing toners include pulverization and polymerization. In the polymerization process, a polymerizable monomer composition is manufactured by uniformly dissolving or dispersing a polymerizable monomer, a colorant, a polymerization initiator and, if needed, various other additives, such as a cross-linking agent and an antistatic agent. Next, the polymerizable monomer composition is dispersed in an aqueous dispersive medium, which includes a dispersion stabilizer, using an agitator to form minute liquid droplet particles.

Subsequently, a temperature is increased and suspension polymerization is performed to obtain a polymerized toner having colored polymer particles of a desired size. In particular, there has been proposed a method for preparing a toner with a structure of a core and a shell which can be prepared by forming the core using a vinyl monomer and an initiator, and then forming the shell by polymerizing a vinyl monomer having particles whose hydrophilicity is larger than or equal to that of the particles of the core and having a larger glass transition temperature (Tg) than that of the core. However, this proposed method has limitations in that the shell needs to be thick in order to create a core-shell structure and also to improve a storability.

In the pulverization method, the toner is obtained by melting and mixing synthetic resins with colorants and, if needed, other additives, pulverizing the mixture, and then classifying the particles until particles of a desired size are obtained. However, in view of the features of the toner prepared by pulverization and drying, when the content of the wax is greater than 2.5% by weight, a durability and a storage stability of the toner is impaired. Accordingly, it is not desirable to increase the content of the wax for the purpose of preventing an offset phenomenon or improving the fixing ability of the toner. In addition, the toner prepared by pulverization unavoidably includes portions of wax protruding outwardly, the waxes serve as external additives during a pulverizing process, but cause part of the toner to be blocked, thereby resulting in a poor image quality and a deteriorated storage stability of the toner.

Due to a recent demand for high speed image forming devices, in an electrophotographic imaging apparatus using electrophotography or electrostatic recording, such as a photocopier, a laser printer, or an electrostatic recorder, toners for developing an electrostatic image which use a low-temperature fixing developer would be desirable.

SUMMARY OF THE INVENTION

The present general inventive concept provides a toner having improved fixing ability, exhibiting reduced toner blocking and offset phenomena by improving durability of the toner, preventing blocking and offset phenomena of toner and increasing fixing ability.

Additional aspects and/or utilities of the present general inventive concept will be set forth in part in the description which follows and, in part, will be obvious from the description, or may be learned by practice of the general inventive concept.

The present general inventive concept also provides a process of preparing the toner.

The present general inventive concept also provides a method of forming a high-quality image using the toner and exhibiting a low-temperature fixing property.

The present general inventive concept also provides an apparatus of forming a high-quality image using the toner and exhibiting a low-temperature fixing ability.

The foregoing and/or other aspects and utilities of the present general inventive concept may be achieved by providing a toner which includes a core which contains a binder resin, wax, and a colorant, and an external additive layer to coat the core, wherein the core is prepared such that the core is extruded and extended to have a fiber phase, and is pulverized.

The foregoing and/or other aspects and utilities of the present general inventive concept may be achieved by providing a process of manufacturing a toner which includes preparing a melted product to form a core by melt-kneading a binder resin, wax, and a colorant, extruding the resultant melted product through a micro-capillary die to obtain an unextended core, extending the unextended core, pulverizing the extended core having a fiber phase, and coating the pulverized core with an external additive layer containing silica, metallic oxide, and polymer beads.

The foregoing and/or other aspects and utilities of the present general inventive concept may be achieved by providing an image forming method which includes forming a visible image by attaching a toner on a surface of a photoreceptor on which an electrostatic latent image is formed and transferring the visible image onto a transferring member, wherein the toner includes a core which contains a binder resin, wax, and a colorant, and an external additive layer to coat the core and the core is prepared such that the core is extruded and extended to include a fiber phase and is pulverized.

The foregoing and/or other aspects and utilities of the present general inventive concept may be achieved by providing an image forming apparatus which includes an organic photoreceptor, a means for charging a surface of the organic photoreceptor, a means for forming an electrostatic latent image on the surface of the organic photoreceptor, a means for receiving the toner described above, a means for forming a toner image by supplying the toner to develop the electrostatic latent image of the organic photoreceptor, and a means for transferring the toned image from the photoreceptor to a transferring member.

The foregoing and/or other aspects and utilities of the present general inventive concept may be achieved by providing a toner usable with an image forming apparatus which includes a fibril-shaped core and an external additive layer to coat the fibril-shaped core, wherein the fibril-shaped core contains a colorant.

BRIEF DESCRIPTION OF THE DRAWINGS

The above and/or other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
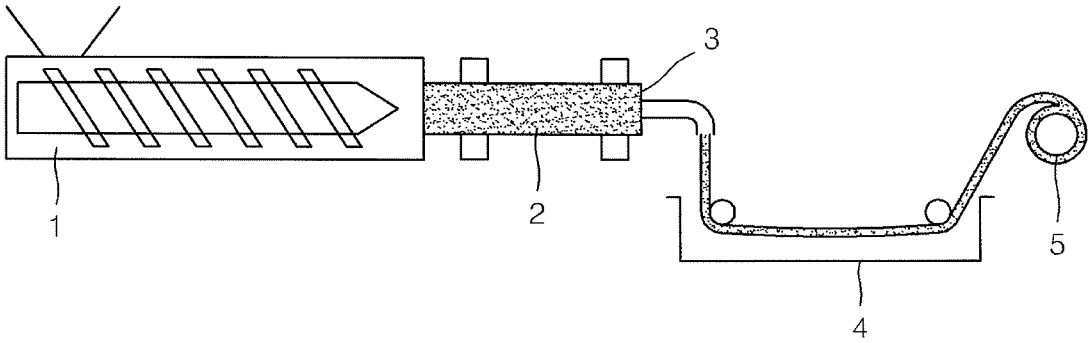
FIG. 1 schematically illustrates a process of preparing a toner according an exemplary embodiment of the present general inventive concept.

The present general inventive concept will now be described in more detail.

Reference will now be made in detail to exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

The present general inventive concept provides a toner which includes a core containing a binder resin, wax, and a colorant, and an external additive layer to coat the core, wherein the core is prepared such that the core is extruded and extended to include a fiber phase, and is pulverized.

In exemplary embodiments, the core may have a fibril structure by extruding a melted product containing the binder resin, wax, and the colorant, and extending the core by a fiber spinning process. In exemplary embodiments, the fibril structure may have a diameter of about 1 nm. However, the present general inventive concept is not limited thereto.

In exemplary embodiments, the extended core having a fiber phase includes a large aspect ratio and a small cross-sectional diameter, and the wax contained therein is easily transformed from droplets into fibrils in order to yield improved adhesion between the binder resin and the waxes by increasing mechanical properties thereof. In addition, even when a polymer binder resin is blended with the wax in a maximum amount that is acceptable in a conventional process, the wax of a fibril phase, rather than a wax of a droplet phase, may realize an improved fixing ability and glossiness.

Meanwhile, according to conventional technology, an interfacial tension between a low molecular weight wax and the binder resin in the core is too high to be compatible with each other. Furthermore, even if wax and resin based on a same material group are used, they may not be blended well in a melted state due to a viscosity difference between the two materials. As a result, when the melt-kneading process using an extruder, which is then followed by cooling, pulverizing, classifying, and externally adding additives are performed in order to complete the toner, mechanical properties of the toner are impaired, which deteriorates the toner due to frictional heat between toner particles in a developing device and contact friction between developing members, ultimately resulting in instability of the charge quantity of the toner which impairs an image quality due to a shortened life of toner. In addition, since it is difficult to disperse the wax in the toner, there is a limit in increasing a content of the wax, making it difficult to realize a fixing ability based on a releasing property of the wax and to ensure glossiness in a case of a color toner.

However, since the toner according to an exemplary embodiment of the present general inventive concept includes a fibril-shaped core, several problems associated with the conventional technology can be resolved or significantly reduced. In exemplary embodiments, an aspect ratio of the core, which is a ratio of a major axis to a minor axis, as represented by A/B, may range from about 20 to about 100, where A denotes a major-axis length of a section of the core, and B denotes a minor-axis length of the section of the core. In an exemplary embodiment, an aspect ratio of the core may range from about 40 to about 70. However, the present general inventive concept is not limited thereto.

When an aspect ratio of the core is less than 20, it is difficult to apply a sufficient amount of force required to transform the core into a fibril structure over continuous processing cycles. However, when the aspect ratio of the core is greater than 100, a force applied is sufficient for an initial transformation of the core, but the transformation may be incomplete due to a short retention time in which the core forming material remains in an extruder. Thus, a desired core of a fibril structure cannot be obtained when the aspect ratio is larger than 100.

In exemplary embodiments, a diameter of the core is in a range of about 4 to about 20 μm. In an exemplary embodiment, the diameter of the core is about 5 to about 6 μm. If the diameter of the core is smaller than 4 μm, wax fibrils in the core may be disrupted. However, if the diameter of the core is greater than 20 μm, wax fibrils which are added to the core as an internal additive may not be properly formed.

In exemplary embodiments, any material which includes fibrils that can be melted and extruded by extension may be used as the binder resin contained in the core. For example, exemplary embodiments of the binder resin may include polyester based resin and polystyrene-acryl based resin. However, the present general inventive concept is not limited thereto.

Particularly, in an exemplary embodiment, polyester based resin is used as the binder resin in view of the extension in a melted state.

The polyester based resin is composed of an acidic component and an alcoholic component. In exemplary embodiments, the polyester based resin may also be one type of particulate resin or two or more types of blends. In an exemplary embodiment, an equivalence ratio of the acidic component and an alcoholic component is 1:1 to 1:2. However, the present general inventive concept is not limited thereto.

In exemplary embodiments, the acidic component includes aromatic dibasic acid, polybasic acid of a trimer or higher polymeric acid, and aromatic dibasic acid having a sulfonic salt. However, the present general inventive concept is not limited thereto.

The aromatic dibasic acidic component includes aromatic dibasic acids and/or alkyl esters thereof which are generally used in the manufacture of the polyester based resin. Exemplary embodiments of the aromatic dibasic acid include terephthalic acid andisophthalic acid. However, the present general inventive concept is not limited thereto. Exemplary embodiments of the alkyl esters of the aromatic dibasic acid include dimethyl terephthalate, dimethylisophthalate, diethylterephthalate, diethylisophthalate, dibutylterephthalate, and dibutylisophthalate. The aromatic dibasic acid and alkyl esters thereof may be used alone or in combination. However, the present general inventive concept is not limited to the mentioned alkyl esters.

Non-limiting examples of the polybasic acidic component of a trimer or higher polymeric acid useful in the present general inventive concept include, but are not limited to, trimellitic acid, pyromellitic acid, 1,2,4-cyclohexanetricarboxylic acid 2,5,7-naphthalene tricarboxylic acid, 1,2,4-naphthalene tricarboxylic acid, 1,2,5-hexane tricarboxylic acid, 1,2,7,8-octane tetracarboxylic acid, alkyl esters thereof and/or acid anhydride.

In exemplary embodiments, the aromatic dibasic acidic component having a sulfonic salt, which is one of the acidic components, improves a dispersity and a charge controlling function of the toner colorant, to thereby improve an image quality of a printed matter. In exemplary embodiments, the aromatic dibasic acidic component includes sodium dimethyl 5-sulfoisophthalate, sodium 5-sulfoisophthalate, and/or mixtures thereof. However, the present general inventive concept is not limited thereto.

Exemplary embodiments of the alcohol component of the polyester based resin for the toner according to the present general inventive concept include aliphatic diol, and in an exemplary embodiment 1,2-propane diol. However, the present general inventive concept is not limited thereto. Exemplary embodiments of the aliphatic diol include 1,2-propane diol, ethylene glycol, diethylene glycol, neopentyl glycol, and 1,4-butane diol. In an exemplary embodiment, 1,2-propane diol is used since it facilitates reactivity control during the polymerization of the polyester based resin. However, the present general inventive concept is not limited thereto.

In exemplary embodiments, the binder resin has a softening point in a range of about 90 to about 170° C. In an exemplary embodiment, the binder resin has a softening point in a range of about 95 to about 135° C. When the softening point of the binder resin is lower than 90° C., the durability and storage stability of the toner are poor. However, when the softening point of the binder resin is greater than 170° C., the glossiness and the fixing ability of the toner are poor.

In exemplary embodiments, the binder resin has a number average molecular weight in a range of about 1,000 to about 120,000. In an exemplary embodiment, the binder has a number average molecular weight in a range of about 5,000 to about 50,000. When the number average molecular weight of the binder resin is less than 1,000, a durability of the toner undesirably decreases. However, when the number average molecular weight of the binder resin is greater than 120,000, the fixing ability of the toner undesirably decreases.

In exemplary embodiments, a wax may be appropriately selected according to a desired purpose of the final toner. Exemplary embodiments of the wax include polyethylene wax, polypropylene wax, silicone wax, paraffin wax, ester wax, carnauba wax, and metallocene wax, and the like. However, the present general inventive concept is not limited thereto.

In an exemplary embodiment, the melting point of the wax is about 50 to about 150° C. The components of the wax are physically adhered to the toner particles, however the components of the wax are not covalently bonded with the toner particles. In an exemplary embodiment, the components of the wax are closely adhered to the toner particles.

When the wax has a melting point in the range as stated above, a releasability may be effectively exhibited. The higher the melting point of the wax, the poorer a dispensability of the toner particles. The lower the melting point of the wax, the higher the dispensability of the toner particles. However, in consideration of an environmental factor of an electrophotographic device, in which the toner is actually used, and the fixing ability of a finally printed image, a melting point of the wax is about 50 to about 150° C. The components of the wax are physically closely adhered to the toner particles, however the components of the wax are not covalently bonded with the toner particles. The final toner composition is fixed on a final image receptor at a low fixing temperature and exhibits excellent final image durability and resistance to abrasion.

In exemplary embodiments, the content of the wax in the toner may be about 1 to about 20 parts by weight, based on 100 parts by weight of the binder resin. In an exemplary embodiment, the content of the wax in the toner may be about 2 to about 6 parts by weight, based on 100 parts by weight of the binder resin. When the content of the wax is less than 1 part by weight based on 100 parts by weight of the binder resin, the releasing property of the toner is reduced. However, when the content of the wax is greater than 20 parts by weight, a durability and pulverizing and classifying performance of the toner are undesirably decreased.

As described above, as the core having the fibril structure is formed by a method which includes melt-extrusion and extension of the composition of forming the core, the wax contained in the core exists in a fiber phase, rather than in a droplet phase. As a result, an interfacial tension between the wax in the core and the binder resin is reduced to increase a compatibility between the wax and the binder resin, thereby increasing an amount of the wax which is used in the core. Consequently, the fixing ability and a glossiness of the toner may be improved.

For black toner, in exemplary embodiments, carbon black or aniline black may be used as a colorant which is internally added to the core in the toner. The toner according to an exemplary embodiment of the present general inventive concept is efficient for preparing color toner. For color toner, carbon black is used as a black colorant, and at least one of yellow, magenta, and cyan colorants is used as colored colorants. However, the present general inventive concept is not limited thereto.

For the yellow pigment, condensation nitrogen compound, isoindolinone compound, anthraquinone compound, azo metal complex, or alyl imide compound may be used. In exemplary embodiments, C.I. pigment yellow 12, 13, 14, 17, 62, 74, 83, 93, 94, 95, 109, 110, 111, 128, 129, 147, 168, 180, and the like may be used. However, the present general inventive concept is not limited thereto.

For the magenta pigment, condensation nitrogen compound, anthraquinone, quinacridone compound, basic dye rate compound, naphthol compound, benzo imidazole compound, thioindigo compound, or perylene compound may be used. In exemplary embodiments, C.I. pigment red 2, 3, 5, 6, 7, 23, 48:2, 48:3, 48:4, 57:1, 81:1, 122, 144, 146, 166, 169, 177, 184, 185, 202, 206, 220, 221, or 254, and the like may be used. However, the present general inventive concept is not limited thereto.

For the cyan pigment, copper phthlaocyanine compound and derivatives thereof, anthraquinone compound, or basic dye rate compound may be used. In exemplary embodiments, C.I. pigment blue 1, 7, 15, 15:1, 15:2, 15:3, 15:4, 60, 62, 66, and the like may be used. However, the present general inventive concept is not limited thereto.

Such colorants may be used alone or in combination, and are selected in consideration of color, chromacity, luminance, resistance to weather, dispersion property in toner, and the like. However, the present general inventive concept is not limited thereto. That is, the colorant may be selected based other desired properties.

The content of the colorant is appropriate when the content of the colorant is enough to color the toner, for example about 0.6 to about 6 parts by weight, and preferably about 1 to 4 parts by weight, based on 100 parts by weight of the binder resin. However, the present general inventive concept is not limited thereto. However, when the content of the colorant is less than 0.6 parts by weight based on 100 parts by weight of the binder resin, the coloring effect is not sufficient. When the content of the colorant is greater than 6 parts by weight, manufacturing costs of the toner increase, and a sufficient frictional charge amount cannot be obtained.

The toner according to the present general inventive concept may additionally include a charge control agent in the core. In exemplary embodiments, the charge control agent may be selected from the group consisting of a salicylic acid compound containing a metal, such as zinc or aluminum, boron complex of bis diphenyl glycolic acid, and silicate. In exemplary embodiments, dialkyl salicylic acid zinc, {boro bis(1,1-diphenyl-1-oxo-acetyl potassium salt)}, and the like may be used. However, the present general inventive concept is not limited thereto.

In exemplary embodiments, an amount of a charge control agent may be between about 0.5% and 5% by weight, based on 100% by weight of the binder resin contained in the core. In an exemplary embodiment, an amount of the charge control agent may be between about 0.8% and about 3% by weight, base on 100% by weight of the binder resin contained in the core. When the amount of the charge control agent is less than 0.5% by weight, the charge control agent has no substantial effect, and when the amount of the charge control agent is greater than 5% by weight, an overcharge may undesirably occur.

Further, the toner according to the present general inventive concept may additionally include a release agent. In exemplar embodiments, the release agent may be optionally used to protect a photoreceptor and prevent or substantially reduce a deterioration of developing, thereby obtaining a high or substantially improved quality image.

According to an exemplary embodiment of the present general inventive concept, the release agent may be a high purity solid fatty acid ester material. Exemplary embodiments of the release agent include low molecular weight polyolefins such as low molecular weight polyethylene, low molecular weight polypropylene, low molecular weight poly butylenes, and others; paraffin wax: multi-functional ester compound, and the like. However, the present general inventive concept is not limited thereto. The release agent used in the current exemplary embodiment of the present general inventive concept may be a multifunctional ester compound composed of alcohol having three or more functional groups and a carboxylic acid. However, the present general inventive concept is not limited thereto.

In exemplary embodiments, the release agent may be used in an amount of about 1 to about 20 parts by weight, based on 100 parts by weight of the binder resin. In an exemplary embodiment, the release agent may be used in an amount of about 2 parts to about 6 parts by weight, based on 100 parts by weight of the binder resin. When the amount of the release agent used is less than 1% by weight, the release agent has no substantial additional effect, that is, microcrystalline deformation in a melted state is unstable, which is disadvantageous in wax fibril formation. However, when the amount of the release agent is greater than 20% by weight, pulverizing/classifying performance becomes poor, thereby resulting in a reduction in a yield of the toner.

In exemplary embodiments, the external additive layer which coats the core contains external additives, such as silica, metallic oxide, polymer beads, and the like. However, the present general inventive concept is not limited thereto.

In exemplary embodiments, silica added as the external additive is contained in the core in an amount of about 0.1 to about 10 parts by weight, based on 100 parts by weight of a total content of the binder resin. In an exemplary embodiment, silica added as the external additive is contained in the core in an amount of about 0.2 to about 3 parts by weight, based on 100 parts by weight of the total content of the binder resin. If the amount of silica is less than 0.1 parts by weight, a flowability of the toner may be reduced. However, if the amount of silica is greater than 10 parts by weight, a printed product image using the toner may be contaminated, which in turn may result in a deteriorated developing quality and a reduced fixing ability.

Silica is usually used as a moisture absorbing agent and may perform various functions according to its particle size. Silica having a primary particle size of about 30 nm to about 200 nm is referred to as larger average particle diameter (macroparticle) silica, and silica having a primary particle size of about 5 nm to about 20 nm is referred to as smaller average particle diameter (microparticle) silica.

As used herein, a "primary particle" includes an individual particle as opposed to polymerization or agglomeration of two or more individual particles. The smaller average particle diameter silica is mainly added to increase a flowability of toner particles, while the larger average particle diameter silica is often added to impart electroconductivity to the toner particles. The silica used as the external additive in the present general inventive concept includes smaller average particle diameter silica and larger average particle diameter silica in a predetermined ratio.

That is to say, in exemplary embodiments, the silica includes a volume-average particle diameter of about 30 to about 200 nm. In an exemplary embodiment, the silica includes a volume-average particle diameter of about 5 to about 20 nm.

In the current exemplary embodiment, the smaller average particle diameter silica is contained in an amount of about 10 to about 80% by weight, based on a total content of the silica including the smaller average particle diameter silica and larger average particle diameter silica. In an exemplary embodiment, the smaller average particle diameter silica is contained in an amount of about 25 to about 65% by weight, based on a total content of the silica including the smaller average particle diameter silica and larger average particle diameter silica. When the amount of the smaller average particle diameter silica is less than 10% by weight, a smoothness and a glossiness of the electrophotographic recording media are undesirably reduced.

However, when an amount of the smaller average particle diameter silica is greater than about 80% by weight, no substantial effect of adding the two types of silica having different volume-average particle diameters to the toner is demonstrated.

The primary particle sizes of the smaller average particle diameter silica and the larger average particle diameter silica included in the external additive layer are determined in consideration of a compatibility with the toner particles and the toner particle size.

In addition to the silica, in exemplary embodiments, the external additive may be a metallic oxide. The metallic oxide controls excessive charging, which may occur when the external additive contains only silica. A content of the metallic oxide added is in a range of about 0.01 to about 1 parts by weight, based on 100 parts by weight of the binder resin. In an exemplary embodiment, the content of the metallic oxide added is in a range of about 0.05 to about 0.7 parts by weight, based on 100 parts by weight of the binder resin. When the content of the metallic oxide is less than 0.01 parts by weight, the charge controlling effect may not be demonstrated. However, when the content of the metallic oxide is greater than 1 part by weight, no change is caused in view of the charge stability effect.

Exemplary embodiments of the metallic oxide include titanium oxide, or strontium titanate. In an exemplary embodiment, titanium oxide which has an excellent charge stability, depending on environmental factors, is used as the external additive. However, the present general inventive concept is not limited thereto.

Titanium oxide exists in various forms having different acid values, including titanium oxide ($TiO_2$), which is most commonly used. When titanium oxide is dissolved with an alkali, it is turned into an alkali titanate. Titanium oxide is mainly used as a white dye (titan white) having excellent shielding ability and its usage may be selected as appropriate from a wide range of materials, including a porcelain material, a polishing agent, medical products, cosmetics, and so on. In an exemplary embodiment, titanium oxide used in the present general inventive concept is surface-treated with alumina and organopolysiloxane, and has a primary particle size in a range of about 10 to about 200 nm. Similar to silica, a particle diameter of titanium oxide may be determined in consideration of a compatibility with toner particles and the toner particle size. In exemplary embodiments, the surface-treated titanium oxide includes a surface area of about 20 to about 100 $m^2/g$ according to the BET method.

In addition to the above-described metallic oxide and silica, in an exemplary embodiment, the external additive layer of the toner may further include polymer beads as the external additive. As the polymer bead, styrene resin, methyl methacrylate resin, styrene-methyl methacrylate copolymer, acrylic resin, and styrene-acrylic copolymer, may be used alone or in any combination thereof. Since the resin beads are prepared by polymerization, such as suspension polymerization, they are sphere shaped and have a wide particle size distribution from sub microns to several tens of microns.

In exemplary embodiments, the polymer beads may be contained in the external additive layer in an amount of about 0.1 to about 10 parts by weight, based on 100 parts by weight of the binder resin. In an exemplary embodiment, the polymer beads may be contained in the external additive layer in an amount of about 1 to about 6 parts by weight, based on 100 parts by weight of the binder resin.

When the amount of the polymer beads is less than 0.1 parts by weight, the electroconductivity may become poor. However, when the amount of the polymer beads is greater than 10 parts by weight, a printed product image using the toner may be contaminated.

In addition, in order to attain enhanced functionality, the toner according to the present general inventive concept may further include various internal or external additives. In exemplary embodiments, the toner composition may further include other internal or external additives used either alone or in any combination of at least two additives selected from the group consisting of a UV stabilizer, a mildewcide, a sterilizing agent, a fungicide, an antistatic agent, a gloss modifier, an anti-oxidant, and a deflocculant such as silane or silicone-modifying silica particles. In exemplary embodiments, the internal or external additive may be used in an amount of 0.1 to 10 parts by weight, based on 100 parts by weight of the binder resin. However, the present general inventive concept is not limited thereto.

The toner according to an exemplary embodiment of the present general inventive concept has a volume-average particle diameter of about 3 to about 10 μm. In an exemplary embodiment, the toner has a volume-average particle diameter of about 4 to about 8 μm. When the volume-average particle diameter of the toner is less than 3 μm, problems associated with the cleaning of an organic photoconducting cartridge (OPC) and a reduced yield in mass production results. However, when the volume-average particle diameter of the toner is greater than 10 μm, electroconductivity becomes unstable, the fixing ability of the toner is reduced, and a toner layer is difficult to regulate using a doctor-blade.

An exemplary embodiment of a toner according to the present general inventive concept may be prepared in the following manner. However, the present general inventive concept is not limited thereto.

That is, a process of preparing the toner according to the present general inventive concept includes preparing a melted product used to form a core by melt-kneading a binder resin, wax, and a colorant, extruding the resultant melted product through a micro-capillary die to obtain an unextended core, extending the unextended core, pulverizing the extended core having a fiber phase, and coating the pulverized core with an external additive layer containing silica, metallic oxide and polymer beads. However, the present general inventive concept is not limited thereto.

With regards to various components used in the process, the binder resin, the wax, the colorant, the charge control agent, the silica, the metallic oxide, and the polymer beads may be used in the same or substantially similar weight ratios as described above. In exemplary embodiments, the extruding is carried out using an extruder with a micro-capillary die. However, the present general inventive concept is not limited thereto.

FIG. 1 schematically illustrates a process of preparing a toner according to an exemplary embodiment of the present general inventive concept. Referring to FIG. 1, an extruder 1 melt-kneads a binder resin, wax, a colorant, and a charge control agent, yielding a melted product used to form a core. The resultant melted product passes through a static mixer 2 and is then extruded by a micro-capillary die 3, yielding an unextended core. Then, the unextended core is extended in a tank 4 to prepare the core having a fiber phase. In the extending, the unextended core is sufficiently relaxed in the tank 4 which is adjusted at a temperature of about 5 to about 10° C. to then be extended in a desired extension ratio using a take-up motor 5.

In preparing the core extended by the extruder 1 to have a fibril structure, the various operating conditions of the extruder 1, including a core forming composition-feeding speed in the extruder, a rotational speed of screws of the extruder 1, a melting point, a discharge pressure of the static mixer 2, a take-up speed of the take-up motor 5, and so on are controlled appropriately.

In exemplary embodiments, the feeding speed is set to about 5 to about 50 kg/hr. In an exemplary embodiment, the feeding speed is set to about 20 to about 40 kg/hr. When the feeding speed is less than 5 kg/hr, a retention time in which the various core forming composition materials stay in the extruder 1, is prolonged, which may deteriorate a flowability of the toner. However, when the feeding speed is greater than 50 kg/hr, a short retention time may be caused, which makes it difficult or impossible to properly control the flowability of the toner.

In exemplary embodiments, the screw speed of the extruder 1 is in a range of about 50 to about 400 rpm. In an exemplary embodiment, the screw speed of the extruder 1 is in a range of about 150 to about 350 rpm. When the screw speed is less than 50 rpm, the core forming composition in the extruder 1 is discharged slowly, and therefore an expected yield cannot be attained. However, when the screw speed is greater than 400 rpm, the material in the extruder 1 may not be properly mixed, due to an extremely short retention time.

In exemplary embodiments, the melting point of the core forming composition in the extruder 1 is in a range of about 200 to about 290° C. In an exemplary embodiment, the melting point of the core forming composition in the extruder 1 is in a range of about 240 to about 280° C. When the melting point is lower than 200° C., a shear force in the extruder 1 may overly increase, making it difficult or substantially impossible to process the binder resin, and even if possible, the uniformity of the mixed binder resin would be poor. However, when the melting point is higher than 200° C., the viscosity of the melted product is too low to control the flowability of the toner, which makes it difficult to prepare the core having a fiber phase.

In exemplary embodiments, the discharge pressure of the static mixer 2 is set to about 400 to about 1500 psi. In an exemplary embodiment, the discharge pressure of the static mixer 2 is set to about 480 to about 1000 psi. When the discharge pressure is less than 400 psi, formation of fibrils is difficult to achieve. However, when the discharge pressure is greater than 1500 psi, the formed fibrils are easily broken.

In exemplary embodiments, the take-up speed of the take-up motor 5 is set to about 50 to about 700 rpm. In an exemplary embodiment, the take-up speed of the take-up motor 5 is set to about 95 to about 500 rpm. When the take-up speed is less than 50 rpm, it is difficult to form fibrils in the core and the wax contained in the core. However, when the take-up speed is greater than 700 rpm, the formed fibrils are easily broken.

In exemplary embodiments, the extended fibril-shaped core is then subjected to pulverizing. The pulverizing is carried out in two steps. First, the core is pulverized to have an intermediate particle size of an average particle diameter in a range of several millimeters. Second, the pulverized product is finely pulverized to have an average particle diameter in a range of several to several tens of micrometers. The finely pulverized core is then subjected to classifying. In the classifying, the core is classified into particles having an average particle diameter of about 3 to about 20 μm. In an exemplary embodiment, the core is classified into particles having an average particle diameter of about 5 to about 10 μm.

The present general inventive concept also provides a toner prepared by the method described above.

According to another exemplary embodiment of the present general inventive concept, a method is provided of forming an image which includes forming a visible image by attaching a toner on a surface of a photoreceptor, on which an electrostatic latent image is formed, and transferring the visible image onto a transferring member, wherein the toner includes a fibril-shaped core.

A exemplary embodiment of an electrophotographic image forming process includes a charging, an exposing to light, a developing, a transferring, a fixing, a cleaning, and an erasing process, and a series of operations of forming images on a receiving medium.

In a conventional charging operation, negative or positive charges are applied to a photoreceptor by a corona or charge roller. In the light exposing operation, an optical system, conventionally a laser scanner or a diode arrangement, selectively discharges the charged surface of the photoreceptor in an imagewise manner corresponding to a desired image formed on a final image receptor, to thereby form a latent image. Electromagnetic radiation that can be referred to as "light" includes infrared radiation, visible light, and ultraviolet radiation.

In the developing operation, suitable polar toner particles generally contact the latent image of the photoreceptor, and conventionally, an electrically-biased developer having an identical potential polarity to the toner polarity is used. The toner particles move toward the photoreceptor and are selectively attached onto the latent image by electrostatic electricity, to thereby form a toned image on the photoreceptor.

In the transferring operation, the toned image is transferred to final image receptor from the photoreceptor, and sometimes, an intermediate transferring element is used to transfer the toned image from the photoreceptor to the final image receptor.

In the fixing operation, the toned image of the final image receptor is heated and the toner particles thereon are softened or melted, thereby fixing the toned image on the final receptor. Another way of fixing is to fix the toner on the final receptor under a high pressure with or without heat being applied. In the cleaning operation, the remaining toner on the photoreceptor is removed. Finally, in the erasing process, the charges on the photoreceptor are exposed to light of a predetermined wavelength band and are thereby reduced to a substantially uniform, low value, and thus the residue of the original latent image is removed, and the photoreceptor is prepared for a next image forming cycle.

The present general inventive concept also provides an image forming apparatus which includes an organic photoreceptor, a unit for charging a surface of the organic photoreceptor, a unit for forming an electrostatic latent image on the surface of the organic photoreceptor, a unit for receiving toner, a unit for forming a toner image by supplying toner to develop the electrostatic latent image of the organic photoreceptor, and a unit for transferring the toned image from the photoreceptor to a transferring medium, wherein the toner is obtained by preparing a core having a fibril structure.

Figure 2:
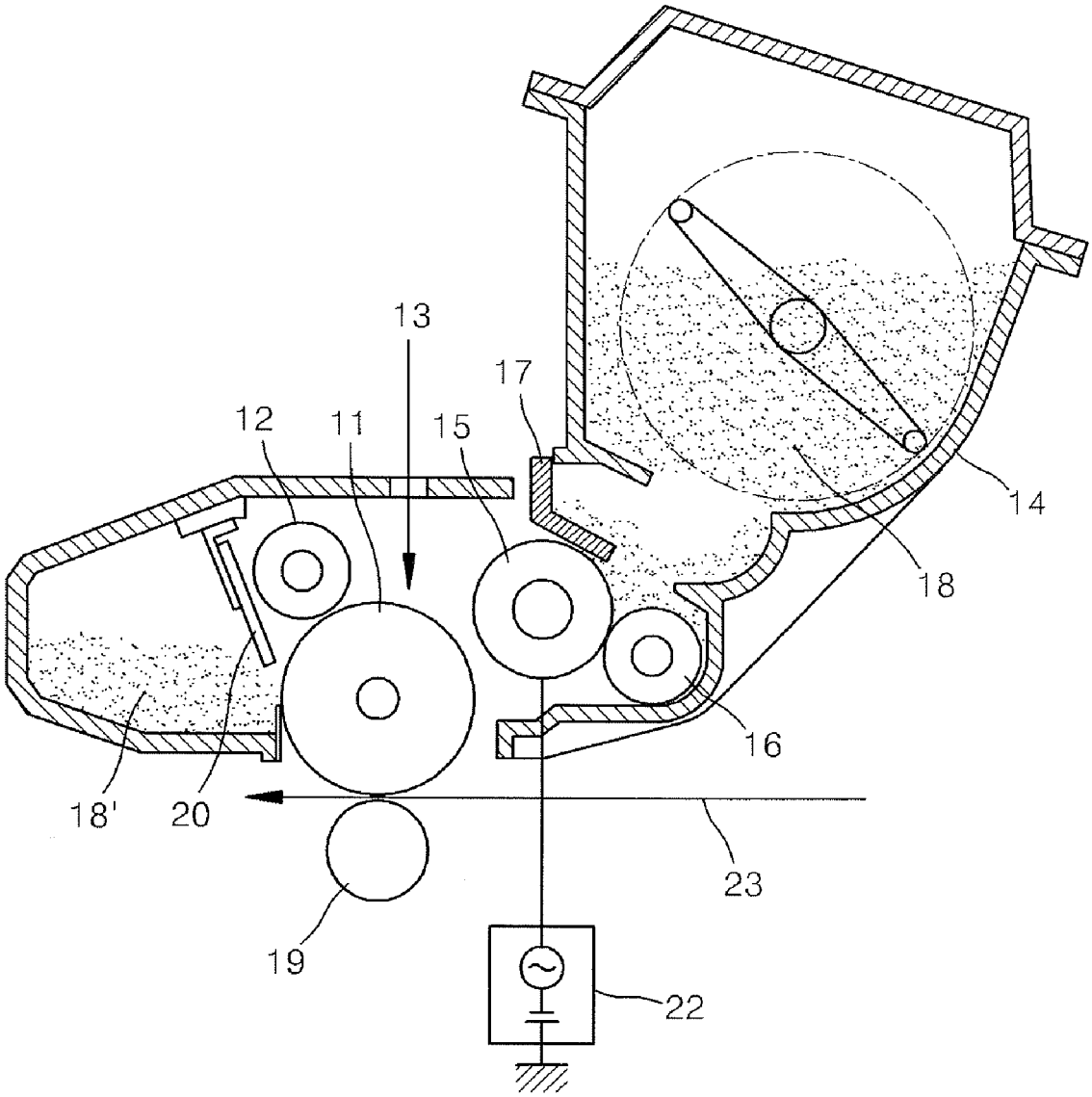
FIG. 2 illustrates an image forming apparatus employing toner prepared by a preparation process of the present general inventive concept, according to an exemplary embodiment of the present general inventive concept.

FIG. 2 illustrates an image forming apparatus employing toner prepared by a preparation process of the present general inventive concept, according to an exemplary embodiment of the present general inventive concept.

A nonmagnetic one-component developer of a developing device 14 transfers a developer 18 to a developing roller 15 using a supply roller 16, which is formed of an elastic member such as polyurethane foam, sponge, or the like. The developer 18 transferred to the developing roller 15 reaches a contact portion of a developer regulation blade 17 and the developing roller 15 by a rotation of the developing roller 15. The developer regulation blade 17 may include an elastic member formed of metal, rubber, or the like. When the developer 18 passes between the contact portion of the developer regulation blade 17 and the developing roller 15, the developer 18 is regulated to a predetermined thickness, and a thin layer of developer 18 is thereby formed. The thin layer of developer 18 is then transferred by the developing roller 15 to a developing region where the developer 18 is developed on an electrostatic latent image of a photoreceptor 11 which is a latent image carrier. In the current exemplary embodiment, the electrostatic latent image is formed by scanning light 13 on the photoreceptor 11.

The developer roller 15 and the photoreceptor 11 face each other with a constant distance therebetween. The developing roller 15 rotates counter-clockwise and the photoreceptor 11 rotates clockwise. However, the present general inventive concept is not limited thereto.

The developer 18 which is transferred to the developing region is developed as an electrostatic latent image of the photoreceptor 11 by electricity generated by a potential difference between an AC voltage from a power supply 22 applied to the developing roller 15 and a potential of the latent image of the photoreceptor 11 that is charged by a charging unit 12.

The developer 18 which is developed on the photoreceptor 11 is transferred to a transfer medium 23, such as a sheet of paper, and as the transfer medium 23 passes through, the developer 18 which is developed on the photoreceptor 31 as corona discharge or as a roller by a transfer unit 19 to which a high voltage having inverse polarity with respect to the developer 18 is applied, thus forming an image.

The image transferred to the transfer medium 23 passes through a high temperature and a high pressure fixing unit (not illustrated) and the developer 18 is fused on the transfer medium 23, thereby fixing the image on to the transfer medium 23. Meanwhile, the remaining developer 18' that is not developed on the developing roller 15 is returned by the supply roller 16 which contacts the developing roller 15. A remaining developer 18' that is undeveloped on the photoreceptor 11 is collected by a cleaning blade 20. The above process is repeated as many times as desired.

The present general inventive concept will now be described in more detail with reference to the examples below. However these examples are for illustrative purposes only and are not intended to limit the scope of the present general inventive concept.

EXAMPLES 1-1 TO 1-4

—Preparation of Melted Product for Forming Core 100 parts by weight of polyester (manufactured by Samyang Corp., Korea) having a glass transition temperature (Tg) of 64° C., softening temperature (Ts) of 95° C., 7% of gel, a number average molecular weight (Mn) of 5,000, a molecular weight polydispersity index (MWD) of 7, 3 parts by weight of carnauba wax (manufactured by Toa Kasei, Japan, in the trade name of Carnauba), 1 part by weight of an iron (Fe)-based charge control agent (T-77; Hodogaya), and 1 part by weight of carbon black (Mogul-L, Cabot) were pre-mixed in a high speed mixer, such as a Henschel mixer, for 10 minutes, and then is transferred into a hopper of an extruder.

—Extruding and Extending

The extruder produced a melted product used to form a core which includes the composition stated above. The extruder was operated under the following operating conditions: a feeding speed of 1.5 kg/hr, a screw speed of 150 rpm, and an internal temperature of the extruder was about 150° C. The melted product passed through a static mixer having a discharge pressure as listed in Table 1 and was then extruded by the micro-capillary die having a diameter of 10 mm, yielding an unextended core. Then, the unextended core was placed in a tank which was adjusted to a temperature of about 5 to about 10° C. and then extended using a take-up motor having take-up speeds as listed in Table 1 and provided with two bobbins, each having a diameter of 15.1 cm, thereby preparing the fibril-shaped core.

In table 1, an extension ratio (%) is expressed by the following equation:

$$\text{Extension Ratio}(\%)=A_{die}/A_{fiber}=V_{take\text{-}up}/V_{die}$$

wherein $A_{die}$ is a cross-sectional area ($mm^2$), $A_{fiber}$ is a sectional area of the core having a fiber phase, $V_{take\text{-}up}$ is a take-up speed (rpm), and $V_{die}$ is a discharge speed in which the extruded product is discharged from the die.

In the extruding and extending process, an apparent shear of the die can be expressed by the following equation:

$$\dot{r}_{app(sec^{-1})} = \frac{32M}{\pi D_{\rho}^{3}}$$

wherein "M" is a flow rate (g/sec) of the extruded product discharged from an exit port of the die, "D" is a diameter of the die (set to 10 mm), and "ρ" is a density ($g/cm^3$) of the melted product.

The shear rates listed in Tables 1 through 3 are measured using Akrotwin software.

TABLE 1

| | Discharge Pressure (psi) of Static Mixer | Take-up Speed (rpm) | Extension Ratio (%) | Shear Rate ($sec^{-1}$) |
|---|---|---|---|---|
| Example 1-1 | 480 | 95 | 102 | 6.8 |
| Example 1-2 | 486 | 200 | 211 | 7.8 |
| Example 1-3 | 492 | 300 | 355 | 8.7 |
| Example 1-4 | 500 | 500 | 533 | 9.2 |

—Pulverizing

The fibril-shaped core was cooled to then be coarsely pulverized, further pulverized using a Bantam Mill to have an average particle diameter in a range of 1 about to about 2 mm, and then finely pulverized to have an average particle diameter in a range of several to several tens of micrometers to be classified to have an average particle diameter in a range of about 6 to 8 μm using a pulverizer (SR-15) and a classifier (TR-15), respectively.

—Coating External Additive Layer 1.0 part by weight of a larger average particle diameter silica, 1.0 part by weight of a smaller average particle diameter silica, 0.1 parts by weight of $TiO_2$, and 0.1 parts by weight of melamine-based polymer beads were mixed with the pulverized core at 3800 rpm for 5 minutes to thus prepare the toner according to the present general inventive concept.

EXAMPLES 2-1 TO 2-4

Toners of Examples 2-1 to 2-4 were fabricated in the same manner as Example 1 except that melted products for forming cores were prepared using 3 parts by weight of polypropylene wax (NP105, MCI), instead of carnauba wax, and 0.2 parts by weight of a zinc (Zn)-based charge control agent (E84-S, ORIENTAL CHEMICAL), instead of an iron (Fe)-based charge control agent (T-77; Hodogaya), respectively, and extruding and extending were carried out under conditions as listed in Table 2.

TABLE 2

| | Static Mixer Discharge Pressure (psi) | Take-up Speed (rpm) | Extension Ratio (%) | Shear Rate ($sec^{-1}$) |
|---|---|---|---|---|
| Example 2-1 | 900 | 90 | 90 | 5.5 |
| Example 2-2 | 940 | 150 | 120 | 6.8 |
| Example 2-3 | 970 | 250 | 250 | 7.6 |
| Example 2-4 | 1000 | 400 | 450 | 8.0 |

EXAMPLES 3-1 TO 3-4

Toners of Examples 2-1 to 2-4 were fabricated in the same manner as Example 1 except that melted products for forming cores were prepared using 3 parts by weight of polypropylene wax (WE-5, Nippon Oil & Fat), instead of carnauba wax, and extruding and extending were carried out under conditions as listed in Table 3.

TABLE 3

| | Static Mixer Discharge Pressure (psi) | Take-up Speed (rpm) | Extension Ratio (%) | Shear Rate ($sec^{-1}$) |
|---|---|---|---|---|
| Example 3-1 | 530 | 90 | 100 | 8.1 |
| Example 3-2 | 550 | 200 | 200 | 8.8 |
| Example 3-3 | 586 | 300 | 330 | 9.4 |
| Example 3-4 | 500 | 500 | 500 | 10.0 |

Figure 3:
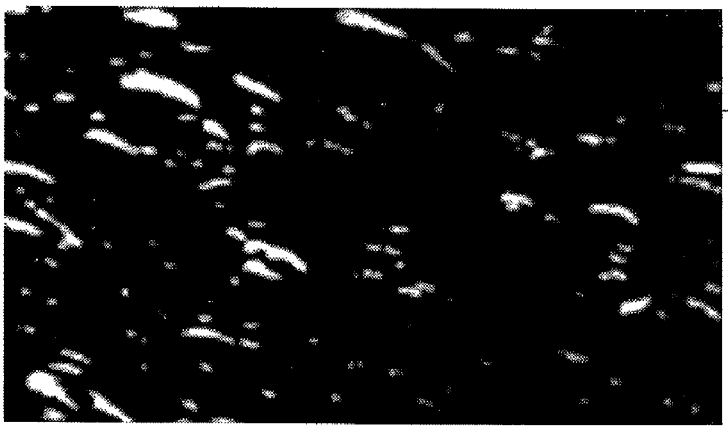
FIG. 3 is a photograph illustrating a cross-section of a toner prepared in Example 1-1 according an exemplary embodiment of the present general inventive concept.
Figure 4:
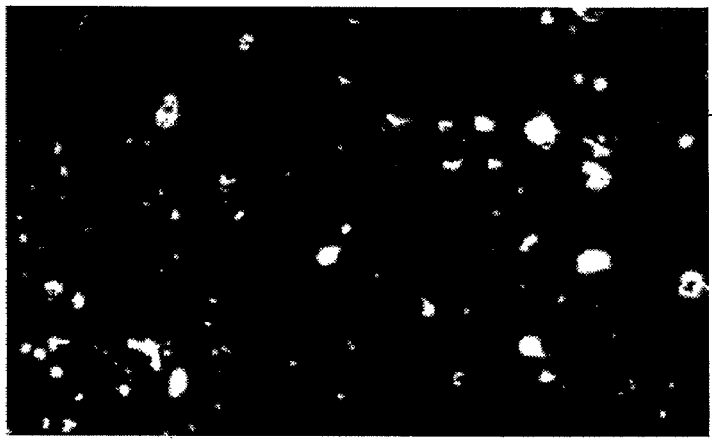
FIG. 4 (RELATED ART)
FIG. 4 is a photograph illustrating a cross-section of a conventional toner that is not extended.

FIGS. 3 and 4 are photographs respectively illustrating cross-sections of a toner prepared in Example 1-1 and a conventional toner that is not extended, in which the white parts represent waxes. As confirmed from the photograph of FIG. 3, the toner 24 according to an exemplary embodiment of the present general inventive concept had the wax transformed from droplets into fibrils so that the state of the wax dispersed in the binder resin and the compatibility of the wax were improved. By contrast, as confirmed from FIG. 4, the conventional toner 25, including a wax, existed as droplets.

The toners prepared in Examples 1-1 to 3-4, each including a fibril-shaped core were transferred to a developing device and tested using a contact developing type and a non-contact developing type printers. The printing test results showed that the printed images had excellent durability and fixing ability even after printing 10K sheets.

That is to say, in the toner according to an exemplary embodiment of the present general inventive concept, since the wax contained in the core of the toner was transformed into fibrils, the mechanical properties of the toner were improved while preventing physical properties of the toner from degrading, due to contact friction between particles of the toner or between developing members. Ultimately, a high quality image was obtained. In addition, since the wax was transformed into a fibril shape, the temperature offset range during fixing of the toner, that is, about 120 to about 200° C., was larger than the conventional offset range, that is, 140 to 190° C. Further, a fixing ability of the toner was also enhanced.

Since the toner according to the present general inventive concept has improved fixing ability to allow the electrostatic image to be fixed at low temperature while having excellent durability and improved storage stability, and exhibiting reduced toner blocking and offset phenomena, it can be advantageously used in an electrophotographic imaging apparatus using electrophotography or electrostatic recording, such as a photocopier, a laser printer, a facsimile machine, or an electrostatic recorder.

While the present general inventive concept has been particularly shown and described with reference to a few exemplary embodiments thereof, it will be understood by those of ordinary skill in the art that various changes in form and details may be made therein without departing from the spirit and scope of the present general inventive concept as defined by the following claims.

What is claimed is:

1. A toner comprising:

a core which contains a binder resin, wax, and a colorant, the core having a fibril-structure and an aspect ratio in which a ratio of a major axis length of a section of the core to a minor axis length of a section of the core ranges from about 40 to about 70; and an external additive layer to coat the core.

2. The toner of claim 1, wherein the core includes a diameter in a range of about 4 to about 20 μm.

3. The toner of claim 1, wherein the core contains 1 to 20 parts by weight of wax, and 0.6 to 6 parts by weight of a colorant, based on 100 parts by weight of the binder resin.

4. The toner of claim 1, wherein the binder resin is polyester based resin or polystyrene-acryl based resin.

5. The toner of claim 1, wherein the binder resin includes a number average molecular weight in a range of 1,000 to 120,000 and a softening point in a range of about 90 to about 170° C.

6. The toner of claim 1, wherein the wax is shaped of a fibril.

7. The toner of claim 1, wherein the melting point of the wax is in a range of about 50 to about 150° C.

8. The toner of claim 1, wherein the colorant is selected from the group consisting of carbon black, aniline black, yellow, magenta, cyan colorants, and combinations thereof.

9. The toner of claim 1, wherein the external additive layer includes silica, metallic oxide, and polymer beads.

10. The toner of claim 1, wherein the external additive contains 0.1 to 10 parts by weight of silica, 0.01 to 1 parts by weight of metallic oxide and 0.1 to 10 parts by weight of polymer beads, based on 100 parts by weight of the total content of the binder resin.

11. The toner of claim 9, wherein the silica includes macroparticles having a volume-average particle diameter of 30 to 200 nm and microparticles having a volume-average particle diameter of 5 to 20 nm.

12. The toner of claim 9, wherein the metallic oxide is titanium oxide ($TiO_2$).

13. The toner of claim 9, wherein the polymer beads include at least one selected from the group consisting of spherical styrene resin, spherical methyl methacrylate resin, spherical styrene-methyl methacrylate copolymer, spherical acrylic resin, and spherical styrene-acrylic copolymer.

14. The toner of claim 1, wherein the toner has a volume-average particle diameter in a range of about 3 to about 10 μm.

15. An image forming apparatus, comprising:

an organic photoreceptor;

a means for charging a surface of the organic photoreceptor;

a means for forming an electrostatic latent image on the surface of the organic photoreceptor;

a means for receiving a toner, the toner comprising:

a core containing a binder resin, wax, and a colorant, the core having a fibril-structure and an aspect ratio in which a ratio of a major axis length of a section of the core to a minor axis length of a section of the core ranges from about 40 to about 70; and an external additive layer coating the core;

a means for forming a toner image by supplying the toner to develop the electrostatic latent image of the organic photoreceptor; and a means for transferring the toned image from the photoreceptor to a transferring member.

16. A toner usable with an image forming apparatus, comprising:

a core containing a colorant and having a fibril-structure and an aspect ratio in which a ratio of a major axis length of a section of the core to a minor axis length of a section of the core ranges from about 40 to about 70; and an external additive layer to coat the fibril-shaped core.

17. The toner of claim 16, wherein the core includes a diameter in a range of about 4 to about 20 μm.

18. The toner of claim 16, wherein the core further includes a resin and a wax.

* * * * *